US011346357B2

(12) United States Patent
Li et al.

(10) Patent No.: US 11,346,357 B2
(45) Date of Patent: May 31, 2022

(54) INDIVIDUAL AXIS DRIVEN THREE STAGE COUNTER ROTATING AXIAL FLOW PUMP

(71) Applicants: Jiangsu University, Jiangsu (CN); Jiangsu University Zhenjiang Fluid Engineering Equipment Technology Research Institute, Jiangsu (CN)

(72) Inventors: Yanjun Li, Jiangsu (CN); Chao Chen, Jiangsu (CN); Ji Pei, Jiangsu (CN); Shouqi Yuan, Jiangsu (CN); Wenjie Wang, Jiangsu (CN)

(73) Assignee: Jiangsu University, Zhenjiang County (CN)

( * ) Notice: Subject to any disclaimer, the term of this patent is extended or adjusted under 35 U.S.C. 154(b) by 0 days.

(21) Appl. No.: 16/470,865

(22) PCT Filed: Jun. 14, 2018

(86) PCT No.: PCT/CN2018/091175
§ 371 (c)(1),
(2) Date: Jun. 18, 2019

(87) PCT Pub. No.: WO2019/200681
PCT Pub. Date: Oct. 24, 2019

(65) Prior Publication Data

US 2021/0324866 A1 Oct. 21, 2021

(30) Foreign Application Priority Data

Apr. 16, 2018 (CN) ..... 201810335702.3

(51) Int. Cl.
*F04D 29/043* (2006.01)
*F04D 3/00* (2006.01)
(Continued)

(52) U.S. Cl.
CPC ..... *F04D 29/043* (2013.01); *F04D 3/00* (2013.01); *F04D 29/046* (2013.01); *F04D 29/181* (2013.01)

(58) Field of Classification Search
CPC ..... F04D 3/00; F04D 19/02; F04D 19/024; F04D 29/181; B63H 11/08
See application file for complete search history.

(56) References Cited

U.S. PATENT DOCUMENTS 3,088,414 A 5/1963 Ozgur
5,634,831 A * 6/1997 Davies ..... B63H 5/10 440/47

(Continued)

FOREIGN PATENT DOCUMENTS

CN 102285441 A 12/2011
CN 202348695 U 7/2012

(Continued)

*Primary Examiner* — Brian P Wolcott
*Assistant Examiner* — Jackson N Gillenwaters
(74) *Attorney, Agent, or Firm* — Hartman Global IP Law; Gary M. Hartman; Domenica N. S. Hartman

(57) ABSTRACT

The invention discloses a kind of single shaft driven level 3 of axial flow pump, including: power source, pumping out, transmission shaft, export fixed vane, the third stage impeller, the second impeller, the first stage impeller, imported fixed vane, pump inlet, the first transmission cone gear, the first cone gear transmission device, the second driving cone gear and the second cone gear transmission device, the invention can realize the opposite steering of the two adjacent impellers by fixing the guide vane and the bevel gear transmission in the impeller hub. With compact structure and small axial size, this single-shaft driven three-stage counter-rotating axial-flow pump can greatly improve the head of the axial pump and widen the efficient zone.

10 Claims, 2 Drawing Sheets

(51) Int. Cl.
*F04D 29/046* (2006.01)
*F04D 29/18* (2006.01)

(56) References Cited

U.S. PATENT DOCUMENTS

| | | | | |
|---|---|---|---|---|
| 9,382,973 | B2 * | 7/2016 | Sappenfield | B23P 15/14 |
| 2004/0009718 | A1 * | 1/2004 | Henmi | B63H 1/18<br>440/66 |

FOREIGN PATENT DOCUMENTS

| | | | |
|---|---|---|---|
| CN | 104358691 | A | 2/2015 |
| DE | 3942672 | A | 12/1989 |
| JP | 2001317481 | A | 11/2001 |

* cited by examiner

INDIVIDUAL AXIS DRIVEN THREE STAGE COUNTER ROTATING AXIAL FLOW PUMP

TECHNICAL FIELD

The invention relates to the structural design of an axial-flow pump, and is applicable to the design field of a three-level opposite-rotating axial-flow pump driven by a single shaft.

TECHNICAL BACKGROUND

At present, the multi-stage pump technology mainly focuses on centrifugal pumps, and there are few reports on the multi-stage axial pump technology. The traditional multi-stage axial pump technology is to change the original rear static blade into a dynamic impeller, and realize the two-stage pairing through dual drive. On the basis of the traditional two-stage counter-rotating axial-flow pump, the invention realizes three-stage counter-rotating axial-flow pump through internal gear transmission, and the first-stage impeller is equivalent to the inducing impeller, which can greatly improve the pump's head and anti-cavitation performance and widen the efficient zone. The invention patent ZL01109653.5 discloses a double-driven axial-flow pump, which broadens the efficient range of the axial-flow pump. However, the structure adopts two-section dual-drive structure design, which is not convenient for installation and use, and at the same time, large hydraulic loss is easily caused by import.

After retrieval, there are no related reports about three-stage contra—rotating axial pump technology.

THE INVENTION CONTENT

In order to realize the single-shaft driven three-level counter-rotating axial-flow pump, the invention provides a three-level counter-rotating axial-flow pump, which can solve the problems of low technical head, narrow high-efficiency zone and poor anti-cavitation performance of the existing axial-flow pump.

For the purpose of the invention, the technical scheme adopted by the invention is: a single-axis driven three-stage counter-rotating axial flow pump, comprising a power source and a transmission shaft, wherein the transmission shaft is sequentially arranged from the pump inlet to the pump out. The utility model has an imported fixed guide vane, a first stage impeller, a second stage impeller, a third stage impeller and an outlet fixed vane, wherein the inlet fixed vane is mounted on the inlet fixed guide impeller hub, and the first stage impeller is installed in the first stage On the first stage impeller hub, the second stage impeller is mounted on the second stage impeller hub, the third stage impeller is mounted on the third stage impeller hub, and the outlet fixed vane is mounted on the outlet fixed guide impeller hub, the inlet fixed guide vane hub and the first stage impeller hub show a connected cavity, and the outlet fixed guide impeller hub and the third-stage impeller hub are connected in a cavity shape, the second impeller hub is connected to the transmission shaft, and the transmission shaft is connected with a first transmission cone gear and a second transmission cone gear, the first transmission cone gear is located at the inlet fixed guide impeller hub and the first stage impeller in the cavity inside the hub, the second transmission cone gear is located in a cavity of the outlet fixed guide impeller hub and the third stage impeller hub, and the first transmission cone gear is fixed to the guide impeller hub through the inlet engaging with a first cone gear transmission in an inner cavity of the first stage impeller hub to drive the first stage impeller hub to rotate in a direction opposite to a rotation direction of the transmission shaft, the second transmission cone gear passing engaging with the second fixed cone gear hub and the second cone gear transmission in the inner cavity of the third stage impeller hub to drive the third stage impeller hub to rotate in a direction opposite to the direction of rotation of the transmission shaft.

In the above scheme, the transmission shaft is located in the imported fixed guide vane hub and the shaft end in the inner cavity of the first stage impeller hub, and the imported fixed guide vane hub is radially fixed through the first deep groove ball bearing, and is axial fixed through the first thrust block. The first transmission cone gear and the first thrust block are fixed axially through the first sleeve.

In the above scheme, the first cone gear transmission device comprises a first carrier, the first carrier is fixed on the inner wall of the inlet fixed guide impeller hub or the first stage impeller hub, and the third transmission cone gear is mounted on the first carrier. The third transmission cone gear meshes with the first transmission cone gear and the first hollow transmission cone gear at the same time, and the first hollow transmission cone gear is fixedly mounted on the inner wall boss of the first stage impeller hub to drive the first stage impeller hub to rotate In the above scheme, the first stage impeller hub is provided with a first support ring and a second support ring, and the second support ring and the first hollow drive cone gear are fixed together on the inner wall of the first stage impeller hub by the first fastening bolt On the stage, the second support ring and the transmission shaft are radially fixed by the third deep groove ball bearing, and the first support ring is fixed on the inner wall boss of the first stage impeller hub by the second fastening bolt, the first support The ring and the transmission shaft are radially fixed by the second deep groove ball bearing, and the third deep groove ball bearing and the second deep groove ball bearing are axially positioned by the second sleeve In the above scheme, the third hub with the third support ring and a fourth support ring, described the third support ring and described the second hollow spiral cone gear transmission through third fastening bolt fixed together it is the third hub inner convex platform, described the third support ring and described between the shaft radial fixed by the fourth deep groove ball bearings, described the fourth fastening bolt support ring through it is the third hub inner convex platform, described the fourth between support ring and described the shaft radial fixed by 5 deep groove ball bearings, In the above scheme, a third thrust block is arranged between the inner wall boss of the second stage impeller hub of the fourth support ring.

In the above scheme, the second cone gear transmission device comprises a second carrier, the second carrier is fixed on the inner wall of the third-stage impeller hub or the outlet fixed guide impeller hub, and the fourth transmission cone gear is mounted on the second carrier. The fourth transmission cone gear meshes with the second transmission cone gear and the second hollow transmission cone gear at the same time, and the second hollow transmission cone gear is fixedly mounted on the inner wall boss of the third-stage impeller hub, and drives the third-stage impeller hub to rotate.

In the above scheme, the third stage impeller hub is provided with a third support ring and a fourth support ring, and the third support ring and the second hollow drive cone gear are fixed together on the inner wall of the third stage impeller hub by the third fastening bolt. On the stage, the third support ring and the transmission shaft are radially fixed by the fourth deep groove ball bearing, and the fourth support ring is fixed on the inner wall boss of the third stage impeller hub by the fourth fastening bolt, the fourth support The fifth deep groove ball bearing is radially fixed between the ring and the transmission shaft, and the fifth deep groove ball bearing and the fourth deep groove ball bearing are axially positioned by the third sleeve.

In the above scheme, the fourth support ring is provided with a third thrust block between the inner wall bosses of the second stage impeller hub.

In the above scheme, the first stage impeller is mounted on the first stage impeller hub by the first adjusting nut, the second stage impeller is mounted on the second stage impeller hub by the third adjusting nut, and the third stage impeller is mounted by the second adjusting nut. On the third stage impeller hub.

In the above scheme, the inlet fixed guide impeller hub, the first stage impeller hub, the second stage impeller hub, the third stage impeller hub and the outlet fixed guide impeller hub are sealed by a sealing ring.

Beneficial effect of the invention: 1. The driving part is installed in the hollow hub of fixed guide vane and impeller, making full use of space, compact structure, small hydraulic loss, small clearance between all levels of impeller and small axial size. 2. The present invention powered by an electric motor which can change the direction of rotation of the impeller at all levels, at the same time of the first transmission spiral cone gear and the first cone gear transmission device, the second cone gear transmission and the regulation of the second cone gear transmission gear ratio to broaden the pump running in high efficient area, improve the inlet pressure of the main impeller, pump cavitation performance are greatly improved, improved the axial flow pump head. The pump operation efficiency is improved by reducing the impact loss of impeller,

THE APPENDED DRAWINGS SHOW

In the FIG.: 1. Power source, 2. Pump outlet, 3. Transmission shaft, 4. Outlet fixed guide vane, 5. Stage 3 impeller, 6. Stage 2 impeller, 7. Stage 1 impeller, 8. Import fixed guide vanes 9. Pump inlet 10. The second driving cone gear, 11. The export of fixed guide vane hub, 12. The fourth driving cone gear, 13. The second gear rack, 14. Second hollow driving cone gear, 16. The third support ring, 17. Fourth deep groove ball bearing, 18. The third fastening bolts, 19. The second adjustment nut, 20. The third sleeve, 21. The third hub, 22. The fourth support ring, 23. The fifth deep groove ball bearing 24. The third thrust block, 25. The fourth fastening bolts, 27 The third adjusting nut, 28 The secondary impeller hub, 29 The second thrust block, 30. The first support ring, 31. The second deep groove ball bearing, 32. The second sleeve, 33. The first stage impeller hub, 34. The second fastening bolt, 35. The first adjustment nut, 36. The second support ring, 37. The third deep groove ball bearing, 38. The first hollow drive cone gear, 39. The third drive cone gear, 40. The first fastening bolt, 41. The first transmission cone gear 42. The first carrier, 44. The first sleeve, 45. The first thrust block, 46. The first deep groove ball bearing, 47. The inlet fixed impeller hub, 48. The sealing ring.

Specific Implementation Mode

The technical scheme of the invention is further explained with the attached figure.

Figure 1:
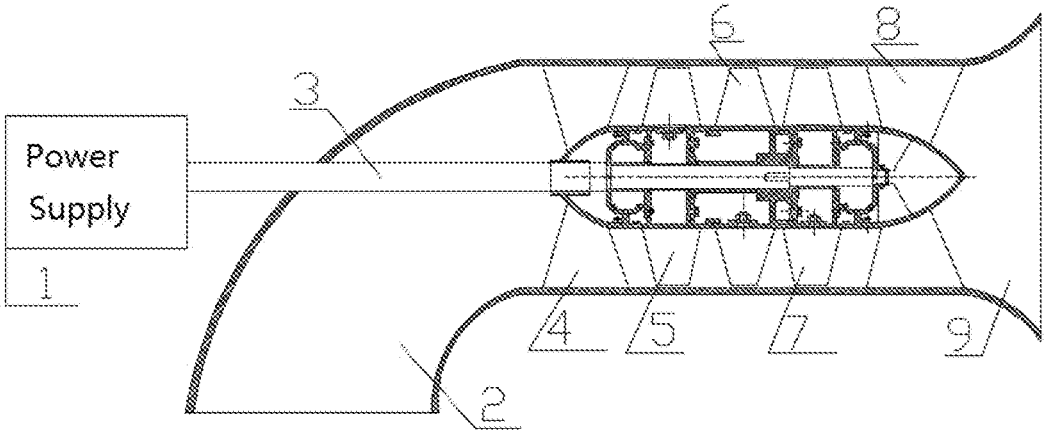
FIG. 1 is a schematic view of the operation of the device of the present invention.

As shown in FIG. 1, a single-shaft driven three-stage counter-rotating axial flow pump of the present invention comprises a power source 1, pump outlet 2, a transmission shaft 3, an outlet fixed vane 4, a third-stage impeller 5, a second-stage impeller 6, and a first stage. The impeller 7, the inlet fixed vane 8 and the pump inlet 9. The liquid flows in from the pump inlet 9 and flows through the inlet fixed vane 8 through the first stage impeller 7 to flow into the second stage impeller 6; after the second stage impeller 6 works, it flows into the third stage impeller 5 through the third stage impeller. 5 After the work, after flowing through the fixed guide vane 4, pump outet 2 flows out.

Figure 2:
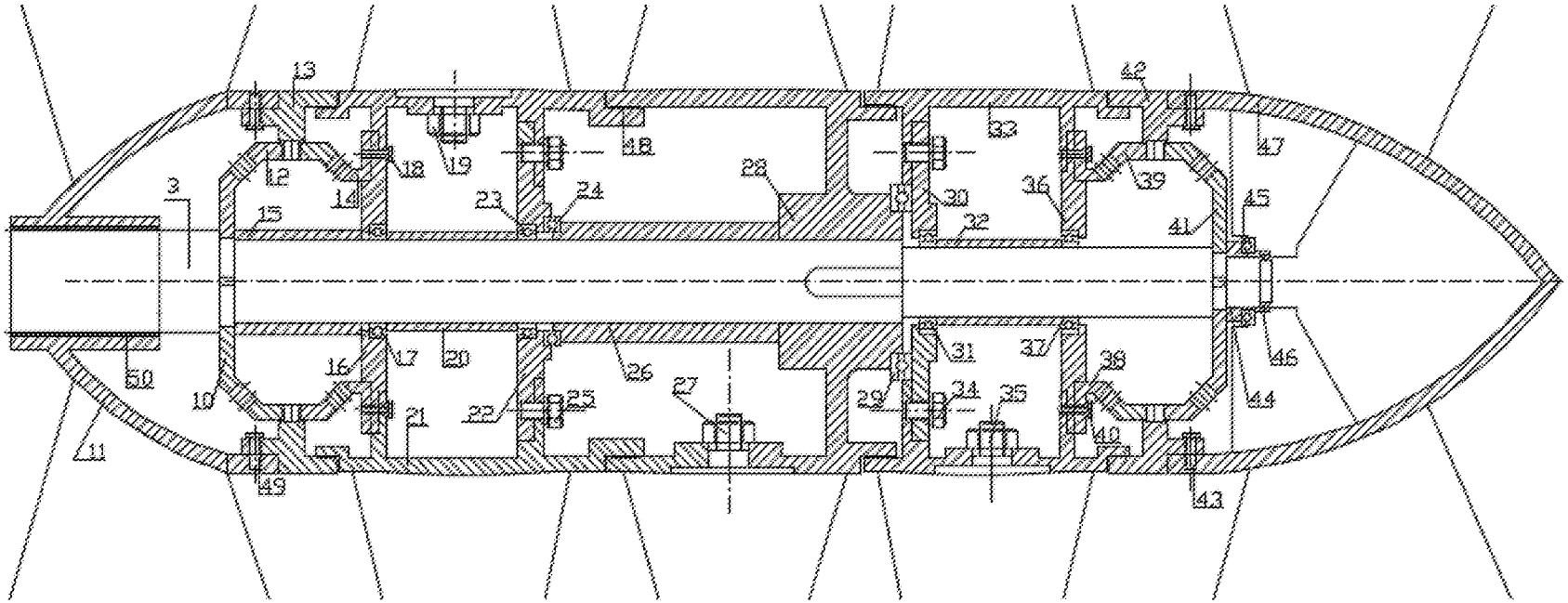
FIG. 2 is a schematic view showing the internal structure of the device of the present invention.

As shown in FIG. 2, in the single-shaft driven three-stage counter-rotating axial flow pump provided by the embodiment, the inlet fixed guide vane 8 is mounted on the inlet fixed guide impeller hub 47, and the first-stage impeller 7 passes through the first adjusting nut 35. Mounted on the first stage impeller hub 33, the second stage impeller 6 is mounted on the second stage impeller hub 28 by a third adjustment nut 27, and the third stage impeller 5 is mounted to the third stage impeller by a second adjustment nut 19. On the hub 21, the outlet fixed vanes 4 are mounted on the outlet fixed guide impeller hub 11, and the transmission shaft 3 sequentially passes through the outlet fixed guide impeller hub 11, the third stage impeller hub 21, the second stage impeller hub 28 and the first stage. The impeller hub 33, the second stage impeller hub 28 is keyed to the transmission shaft 3, and the transmission shaft 3 is connected with a first transmission cone gear 41 and a second transmission cone gear 10, and the first transmission cone gear 41 is located at the inlet fixed guide impeller hub. 47. In the cavity inside the first stage impeller hub 33, the second drive cone gear 10 is located in a cavity inside the outlet fixed guide impeller hub 11 and the third stage impeller hub 21, and the transmission shaft 3 is located at the inlet fixed guide impeller hub 47. The inner end passes through the first deep groove ball bearing 46 and the Thrust block 45 is fixed radially and axially fixed guide inlet 47 of the impeller hub, and the other end is connected to the power source of the pump 1 in vitro. The inlet fixed vane 8 is fixed near the inlet, and the outlet fixed vane 4 is fixed near the outlet. The inlet fixed guide impeller hub 47 has a bearing frame therein for receiving a first thrust block 45 and a first deep groove ball bearing 46 for axially fixing and radially fixing the transmission shaft 3. The first carrier 42 is fixed to the inner wall of the inlet fixed guide impeller hub 47 or the first stage impeller hub 33 by fastening bolts. Since the first transmission cone gear 41 is connected by a key on one end of the transmission shaft 3 near the inlet, this The first transmission cone gear 41 is steered in the same manner as the transmission shaft 3 and transmits power to the third transmission cone gear 39 connected to the carrier 42 via a sliding bearing; the first stage impeller hub 33 is provided with a first support ring 30 and a first The second support ring 36, the second support ring 36 and the first hollow drive cone gear 38 are fixed together on the inner wall boss of the first stage impeller hub 33 by the first fastening bolt 40, and the second support ring 36 and the transmission shaft 3 Radially fixed by a third deep groove ball bearing 37, the first support ring 30 is fixed to the inner wall boss of the first stage impeller hub 33 by a second fastening bolt 34, the first support ring 30 and the transmission shafts 3 are radially fixed by the second deep groove ball bearings 31, and the third deep groove ball bearings 37 and the second deep groove ball bearings 31 are axially positioned by the second sleeve 32. The boss of the first stage impeller hub 33 near the outlet and the first support ring 30 form a card slot, and a second thrust block 29 is mounted in the card slot for axial fixing with the second stage impeller hub 28, thereby making the first The stage impeller 7 and the second stage impeller 6 are axially fixed by the second thrust block 29; the transmission cone gear 39 on the carrier 42 transmits power to the hollow drive cone gear 38, thereby driving the first stage impeller 7 to rotate. And the direction of rotation is opposite to the direction of rotation of the transmission shaft 3; the transmission shaft 3 and the second stage impeller hub 28 are connected by a key to drive the second stage impeller 6 to rotate. The steering of the second stage impeller 6 is the same as that of the transmission shaft 3.

The transmission shaft 3 is connected to the second transmission cone gear 10 by a key on the side close to the outlet fixing vane 4. This second transmission cone gear 10 is steered in the same manner as the transmission shaft 3, and transmits power to the second carrier 13 through the sliding bearing. The fourth transmission cone gear 12, the second carrier 13 is fixed to the inner wall of the outlet fixed guide impeller hub 11 or the third-stage impeller hub 21 by bolts; the fourth hollow transmission cone gear 12 is passed through the third fastening bolt 18 The third support ring 16, the inner wall boss of the third stage impeller hub 21 are connected together, and the fourth drive cone gear 12 mounted on the second carrier 13 transmits power to the second hollow drive cone gear 14, thereby driving the third The stage impeller 5 rotates, the third stage impeller 5 is turned opposite to the transmission shaft 3 and the first stage impeller 7 is the same; the fourth support ring 22 in the third stage impeller hub 21 near the inlet is fixed to the third by the fourth fastening bolt 25 On the inner wall boss of the impeller hub 21, the fourth support ring 22 and the transmission shaft 3 are radially fixed to the impeller through the fifth deep groove ball bearing 23, and the fourth deep groove is passed between the third support ring 16 and the transmission shaft 3. The ball bearing 17 is radially fixed; The fifth deep groove ball bearing 23 and the fourth deep groove ball bearing 17 are axially fixed by the third sleeve 20; the other side of the fourth support ring 22 is mounted with the third thrust block 24 to realize the second stage impeller hub 28 For axial positioning, the first stage impeller 7 is mounted on the first stage impeller hub 33 by a first adjustment nut 35, and the second stage impeller 6 is mounted on the second stage impeller hub 28 by a third adjustment nut 27, third stage The impeller 5 is mounted on the third stage impeller hub 21 by a second adjusting nut 19, which can be realized by adjusting the first adjusting nut 35, the second adjusting nut 19 and the third adjusting nut 27 to the first stage impeller 7, the third The stage impeller 5 and the second stage impeller 6 are placed at an angle. The inlet fixed guide impeller hub 47, the first stage impeller hub 33, the second stage impeller hub 28, the third stage impeller hub 21 and the outlet fixed guide impeller hub 11 are sealed by a sealing ring 48

Preferably, the number of the third transmission cone gears 39 is 3-6; the number of the inner wall bosses of the first stage impeller hub 33 is 3-6, correspondingly the first hollow transmission cone gear 38 and the second support ring The number of threaded holes of 36 is 3-6; the number of fourth transmission cone gears 12 is 3-6; the number of bosses of the inner wall of the third stage impeller hub 21 is 3-6, correspondingly the second hollow transmission The number of threaded holes of the cone gear 14 and the support ring 16 is 3-6

The invention can change the rotation direction of the impellers of each stage by providing power by one motor, and at the same time pass the gear ratio of the first transmission cone gear and the first cone gear transmission, the second transmission cone gear and the second cone gear transmission The adjustment to widen the high-efficiency zone of the pump operation, improve the inlet pressure of the main impeller, greatly improve the cavitation performance of the pump, improve the lift of the axial flow pump, and improve the operating efficiency of the pump by reducing the impact loss of the impeller.

The invention claimed is:

1. An individual axis driven three stage counter rotating axial flow pump includes a power source and a transmission shaft, the individual axis driven three stage counter rotating axial flow pump comprising import fixed guide vanes, a first stage impeller, a second stage impeller, a third stage impeller and an outlet fixed guide vane set up on the transmission shaft successively from a pump inlet to a pump outlet, wherein the import fixed guide vanes are set up on an inlet fixed impeller hub, the first stage impeller is mounted on a first stage impeller hub, the second stage impeller is mounted on a second stage impeller hub, the third stage impeller is mounted on a third stage impeller hub, the outlet fixed guide vane is mounted on an outlet fixed guide impeller hub, the inlet fixed impeller hub and the first stage impeller hub are connected inside a first connected cavity therebetween to define a first bevel gear transmission device, the outlet fixed guide vane hub and the third stage impeller hub are connected inside a second connected cavity therebetween to define a second bevel gear transmission device, the second stage impeller hub is keyed to the transmission shaft, and the transmission shaft is keyed to a transmission cone gear and a second driving cone gear, the transmission cone gear is located at the first connected cavity, the second driving cone gear is located in the second connected cavity, the transmission cone gear drives the first stage impeller hub to rotate in the opposite direction of the rotation direction of the transmission shaft by engaging with the first bevel gear transmission device in the first connected cavity, and the second driving cone gear drives the third stage impeller hub to rotate in the opposite direction of the rotation direction of the transmission shaft by engaging the second bevel gear transmission device in the second connected cavity.

2. The individual axis driven three stage counter rotating axial flow pump according to claim 1, wherein the individual axis driven three stage counter rotating axial flow pump is a single-shaft driven three-stage counter-rotating axial flow pump, the transmission shaft and the inlet fixed impeller hub are radially fixed by at least a first ball bearing, the transmission shaft and the first stage impeller hub are radially fixed by at least a second ball bearing, and the transmission cone gear and a thrust block are axially fixed by a sleeve.

3. The individual axis driven three stage counter rotating axial flow pump according to claim 1, wherein the individual axis driven three stage counter rotating axial flow pump is a single-shaft driven three-stage counter-rotating axial flow pump, the first bevel gear transmission device including a first carrier fixed to an inner wall of the inlet fixed guide impeller hub or the first stage impeller hub, the first carrier is mounted with a third drive cone gear, the third drive cone gear is meshed with the transmission cone gear and a first hollow transmission bevel gear at the same time, and the first hollow drive cone gear is fixed to an inner wall of the first stage impeller hub to drive the first stage impeller hub rotating.

4. The individual axis driven three stage counter rotating axial flow pump according to claim 3, further comprising a first support ring and a second support ring in the first stage impeller hub, the second support ring and the first hollow drive cone gear are fixed together with a first fastening bolt on an inner wall of the first stage impeller hub, the second support ring and the transmission shaft are radially fixed by a third ball bearing, and the first support ring is fixed on an inner wall boss of the first stage impeller hub by a second fastening bolt, the first support ring and the transmission shaft are radially fixed by a second ball bearing, and the third ball bearing and the second ball bearing are axially fixed by a sleeve.

5. The individual axis driven three stage counter rotating axial flow pump according claim 4, wherein the first support ring and the second stage impeller hub have a thrust block disposed therebetween.

6. The individual axis driven three stage counter rotating axial flow pump according to claim 1, wherein the individual axis driven three stage counter rotating axial flow pump is a single-shaft driven three-stage counter-rotating axial flow pump, the second bevel gear transmission device including a gear rack gear fixed on an inner wall of the third stage impeller hub or the outlet fixed guide vane hub, a fourth driving cone gear is fixed on the gear rack, the fourth driving cone gear is simultaneously meshed with a second driving cone gear and a second hollow driving cone gear, and the second hollow driving cone gear is fixedly mounted at the inner wall of the third stage impeller hub, driving the third stage impeller hub to rotate.

7. The individual axis driven three stage counter rotating axial flow pump according to claim 6, wherein a third support ring and a fourth support ring are set on the third stage impeller hub, the third support ring and the second hollow driving cone gear are fixed together on the inner wall of the third stage impeller hub by fastening bolts, the third support ring and the transmission shaft are radially fixed by a fourth deep ball bearing, the fourth support ring is fixed on the inner wall of the third stage impeller hub by fastening bolts, the fourth support ring is radially fixed with the transmission shaft by a fifth ball bearing, and the fifth ball bearing and the fourth ball bearing are axially positioned by a sleeve.

8. The individual axis driven three stage counter rotating axial flow pump according to claim 7, wherein a thrust block is disposed between an inner wall of the fourth support ring and the second stage impeller hub.

9. The individual axis driven three stage counter rotating axial flow pump according to claim 1, wherein the individual axis driven three stage counter rotating axial flow pump is a single-shaft driven three-stage counter-rotating axial flow pump, and the first stage impeller, the second stage impeller, and the third stage impeller are each fixed by an adjustment nut to, respectively, the first stage impeller hub, the second stage impeller hub, and the third stage impeller hub.

10. The individual axis driven three stage counter rotating axial flow pump according to claim 1, wherein the individual axis driven three stage counter rotating axial flow pump is a single-shaft driven three-stage counter-rotating axial flow pump, the inlet fixed impeller hub, the first stage impeller hub, the second stage impeller hub, the third stage impeller hub and the outlet fixed guide vane hub are sealed by a sealing ring.

* * * * *